United States Patent [19]

Parker

[11] 3,987,649

[45] Oct. 26, 1976

[54] DAMAGED NEEDLE DETECTOR WITH SINGLE NEEDLE SENSOR

[76] Inventor: Edward I. Parker, 34 Oak Ridge Road, Holden, Mass. 01520

[22] Filed: Apr. 28, 1975

[21] Appl. No.: 571,949

Related U.S. Application Data

[63] Continuation-in-part of Ser. No. 360,636, May 16, 1973, Pat. No. 3,910,074.

[52] U.S. Cl. ..... 66/157; 324/82

[51] Int. Cl.[2] ..... D04B 35/18

[58] Field of Search ..... 66/157, 163, 165; 324/37 R, 41, 82, 34 R

[56] References Cited

UNITED STATES PATENTS

| | | | |
|---|---|---|---|
| 3,222,664 | 12/1965 | Premact | 324/82 |
| 3,345,563 | 10/1967 | Wood | 324/37 R |
| 3,492,564 | 1/1970 | Baker | 324/41 |
| 3,588,686 | 6/1971 | Lingmann | 324/41 |
| 3,646,542 | 2/1972 | Anthony | 66/157 |
| 3,690,127 | 9/1972 | Tellerman et al. | 66/157 |
| 3,854,084 | 12/1974 | Parker | 324/34 R |
| 3,872,380 | 3/1975 | Gardiner | 324/41 |

OTHER PUBLICATIONS

Beeler, C., *Finding Buried Stuff*, In Radio–Electronics, pp. 42–43, Apr. 1966.

*Primary Examiner*—Mervin Stein
*Attorney, Agent, or Firm*—Charles E. Pfund

[57] ABSTRACT

A detection and control apparatus for a textile machine having a coil through the field of which the machine needles pass individually and a pair of coupled oscillators operating in frequency step with the phase change due to a broken or damaged needle passing through the field of the coil detected as the modulation on the oscillation to control stopping the machine.

5 Claims, 10 Drawing Figures

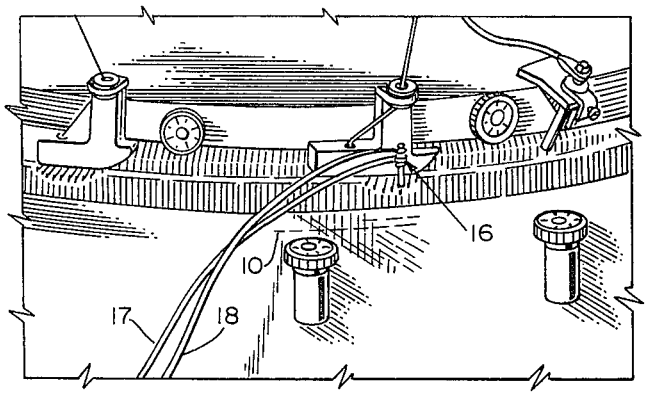
FIG. 2
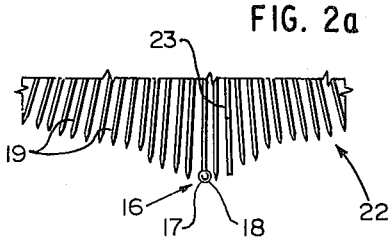
FIG. 2a
FIG. 5
WAVE FORMS
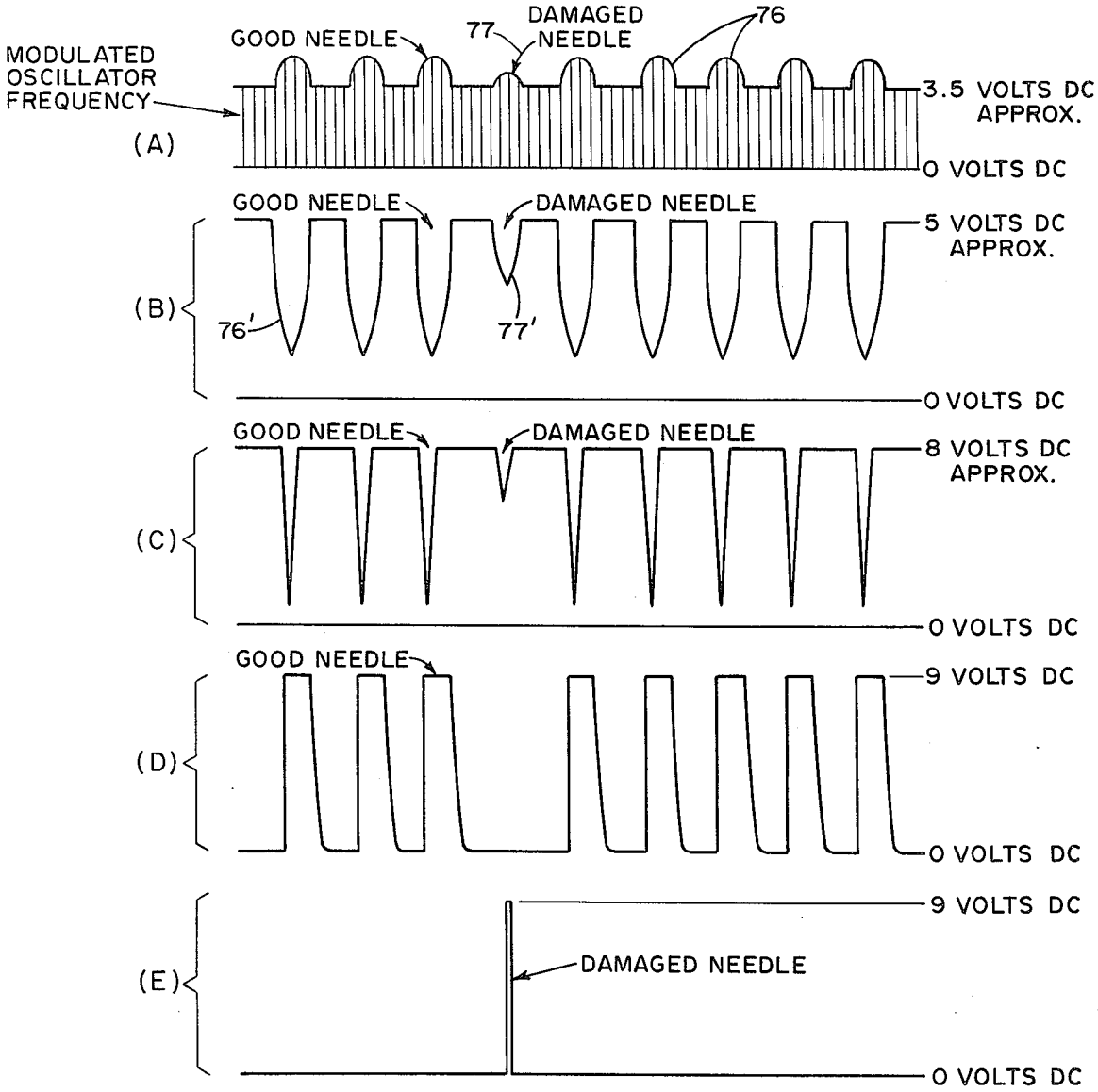

DAMAGED NEEDLE DETECTOR WITH SINGLE NEEDLE SENSOR

CROSS REFERENCE TO RELATED APPLICATION

This application is a continuation-in-part of my copending application U.S. Ser. No. 360,636, filed on May 16, 1973 now U.S. Pat. No. 3,910,074.

BACKGROUND OF THE INVENTION

In the operation of conventional textile machines such as knitting machines and the like, a considerable problem is presented because of the fact that the machine uses a large number of delicate needles operating at high speed. The probability of an individual needle breaking is quite high and, when a needle is broken or damaged such as being bent out of operable position, it introduces a flaw into the fabric. Because the operating area of the machine is necessarily rather inaccessible, the flaw is not noticed until the fabric begins to emerge from the knitting area and this may be some time later. This means that, not only is it necessary to discard or sell cheaply a substantial part of the knitted fabric, but a substantial portion of the operating time of the knitting machine has been used before it is discovered that it is producing inferior fabric. Since the machines represent a substantial capital investment, nonproductive time represents the loss of a portion of the capital investment, so the net cost of saleable fabric is higher.

Attempts have been made in the past to detect broken needles and to shut down the machine when one occurs. However, such attempts have ended in failure because of the high expense of adequate equipment to perform the operation and because the means of doing so have been complicated. Furthermore, shutdown due to false alarms (i.e., a signal erroneously indicating a defective needle) also causes lost productive time. These and other difficulties experienced with the prior art devices have been obviated in a novel manner by the present invention.

It is, therefore, an outstanding object of the invention to provide a detecting apparatus for a textile or knitting machine which is sensitive in operation, so that it can detect a small change in the shape position or breakage of a needle.

Another object of this invention is the provision of a detecting apparatus for a textile machine such as a kitting machine, which apparatus can be applied to existing machines without substantial modification thereof.

A further object of the present invention is the provision of a detecting means for a machine, which means has no mechanical parts to interfere with the knitting operation.

It is another object of the instant invention to provide a detecting apparatus for use in detecting a broken needle in a knitting machine or the like which apparatus is simple in construction, relatively inexpensive to manufacture, and which is capable of a long life of useful service with a minimum of maintenance.

A still further object of the invention is the provision of a detecting apparatus for a knitting machine or the like which is not subject to malfunction due to the presence of lint and other debris in the working area.

Applicant's previous patent discloses and claims arrangements for detecting a broken or missing or deformed needle in a knitting machine wherein a group of such needles pass in sequence through the field of a sensing coil with the novel sensing and detecting circuits arranged to respond to an anomalous inductance altering condition in the group of needles present at any time within the field of the sensing coil. Thus, a missing needle or a broken needle would be detected for its inductance altering effect resulting from the difference in the amount of metal for the group of needles in the field of the coil and where a bent needle produced a similar inductance alteration the apparatus would detect that. At times the ability of the apparatus of applicant's prior patent to detect and stop the knitting operation upon the absence of a needle was considered to be undesired in that many knitting operations involved the intentional removal of one or mroe needles to alter or otherwise effect the pattern of goods being knit. Accordingly, it would be useful to have apparatus which will detect broken needles and other malfunctioning entities but which would not produce a stop motion response due to the complete absence of a needle.

SUMMARY OF THE INVENTION

In general, the invention has to do with a detecting apparatus for use in detecting a defective needle in a textile machine or the like. The apparatus is provided with a first and a second oscillating circuit. The first oscillating circuit contains a test coil and the second oscillating circuit contains a reference coil. Output signals from the two oscillating circuits are received by a conrol circuit which compares the phase and, in the case of predetermined imbalance due to a defective needle, terminates the operation of the machine. A coupling for providing the bidirectional exchange of oscillatory energy is connected between the two oscillating circuits.

The test coil is in the form of a small coil having an inductive field through which individually needles pass such that each needle alters the inductance of the coil when it is present in a maximum field position of the coil relative to a between the needles position in the field of the coil.

The present invention thus is adapted to operate continuously on the sensing in the field of the test coil the difference between a normal needle and the space between needles and respond to the change represented by a broken needle. By the same token, the absence of a needle does not cause a stop motion response since this condition is no different than the condition sensed by the test coil when it is located in the space between normally adjacent needles.

BRIEF DESCRIPTION OF THE DRAWINGS

The invention may be understood by reference to one of its structural forms, as illustrated by the accompanying drawings, in which:

FIG. 2 is an enlarged perspective view of a portion of the knitting machine showing certain details of the detecting apparatus;

FIG. 2*a* is an enlarged detail of a portion of FIG. 2;

FIGS. 5A–5E show waveforms of correspondingly lettered points of the circuit of FIG. 4 useful in describing operating features of the detecting apparatus.

DESCRIPTION OF THE PREFERRED EMBODIMENT

Figure 1:
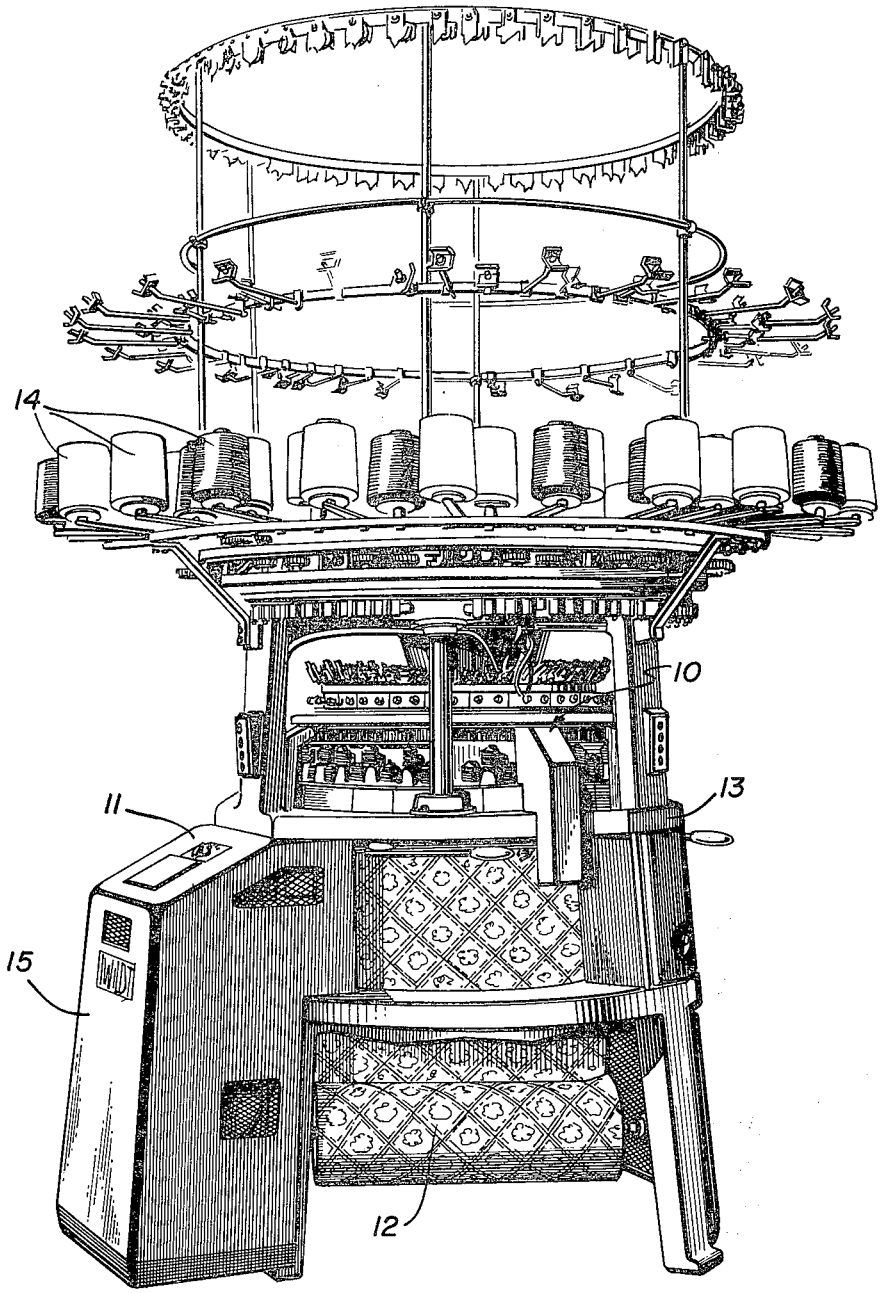
FIG. 1 is a perspective view of a knitting machine incorporating a detecting apparatus according to the principles of the present invention.

Referring first to FIG. 1, wherein are shown the general features of the invention, the detecting apparatus, indicated generally by the reference numeral 10, is shown in use on a knitting machine 11. For the purpose of illustration, the knitting machine is shown as being of the circular type for producing a tube of knitting fabric 12. The knitting machine has a frame 13 on which the detecting apparatus 10 is mounted in proximity to the operating elements of the machine on the interior of the frame. Mounted at the top of the frame are bobbins 14, carrying the raw yarn that is to be guided into the apparatus to form the fabric. Also mounted on the frame is a control cabinet 15 which contains the electrical equipment for controlling the speed of operation of the machine, as well as the usual switches for shutting off the machine.

In FIG. 2 a portion of the detecting apparatus 10 is shown with its cover removed. A test coil 16 is provided with leads 17 and 18 and is mounted adjacent the path of the knitting needles 19. The test coil 16 is in the form of a small solenoid having ferrite core with the axial induction field traversed by the needles individually as they move in a peripheral path around the frame 13.

A horizontal plan view of the coil is shown in FIG. 2*a*. It can be seen that the needles 19 extend in a horizontal row outwardly from the knitting machine and at a certain portion of the knitting machine periphery the needles are moved outwardly by an internal cam (not shown). This cam causes the row of needles to bulge out in a curved envelope 22. The coil is located so that this envelope presents each needle to the field of the coil 16, thus moving the needles of the machine individually through the field of the coil 16 thus affecting the inductance of the coil in an amount determined by the amount and position of the steel in the needle lying within the field of the coil 16. In FIG. 2*a*, one of needles 23 is shown as broken, which interrupts the uniform sequence of inductance values present when the sequence of good needles occurs thus altering the inductance of the coil 16. The presence of the broken needle 23 will bring about the shutdown of the knitting machine, as will be described more fully hereinafter.

Figure 3:
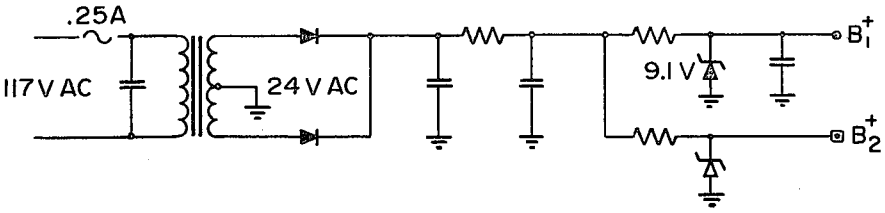
FIG. 3 is an electrical schematic view of a power pack forming part of the detecting apparatus.
Figure 4:
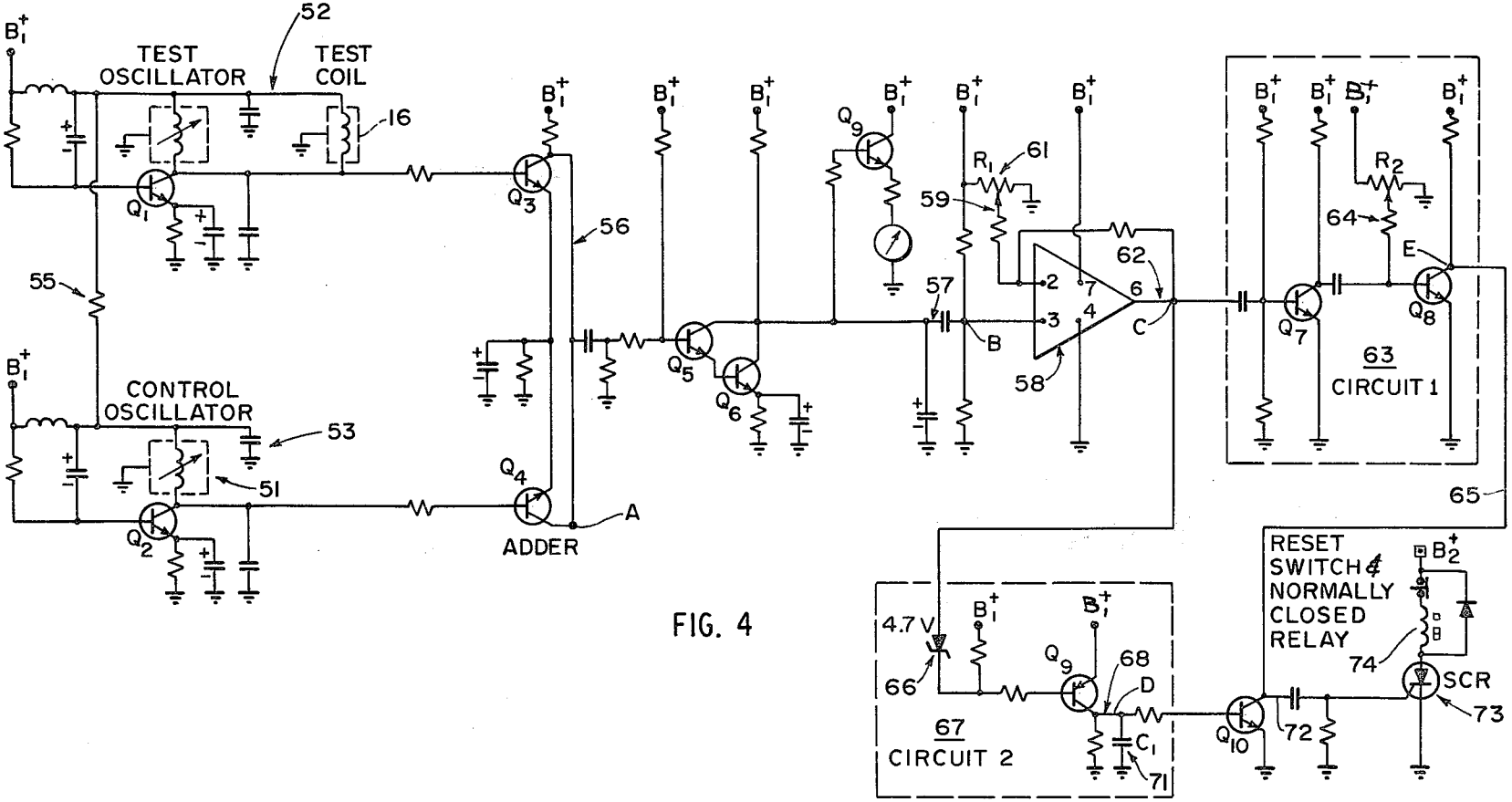
FIG. 4 is an electrical schematic view of the electronic detection and control circuitry of the apparatus.

FIGS. 3 and 4, show the electronic circuits associated with the coil 16. FIG. 4 shows the main detecting circuit, while FIG. 3 shows the power pack which provides operating voltages. In FIG. 3 the power pack 20 is shown as providing rectified and filtered low voltage outputs at terminals $+B_1$ and $+B_2$. Terminal $+B_1$ provides well filtered and regulated voltage at 9.1 volts for all circuits except the relay SCR control circuit which is supplied from terminal $+B_2$.

Referring now to FIG. 4, which shows the details of the detector circuit 50, it can be seen that it incorporates the test coil 16, as well as a reference coil 51. The test coil 16 is incorporated in a first oscillating circuit 52, while the reference coil 51 is incorporated in a second oscillating circuit 53. A coupling resistor 55 is connected between the first and second oscillating circuits for bidirectional transfer of oscillatory energy between the oscillators 52, 53 to lock them in frequency synchronization while permitting relative phase change due to changes in oscillation circuit parameters. In particular, the change in inductance of test coil 16 for the presence or absence of a good needle in the position of maximum inductive field extending on the axis of the coil 16 produces a predetermined phase change between oscillators 52, 53. The predetermined change is altered by a broken, deformed or bent needle to the extent the inductive influence of the needle changes the inductance or resonant parameters of coil 16 in oscillator 52.

The outputs of oscillators 52 and 53 are coupled to the base inputs of transistors Q3 and Q4 which operate to add the oscillations at the predetermined phase displacement and provide at their combined output on line 56 a predetermined level AC signal at the locked oscillator frequency. This signal is applied to a Darlington transistor pair Q5 and Q6 which serves to detect any amplitude oscillation on the AC signal on line 56 and at the filtered output on line 57 provide the modulation signal. Normally the locked oscillatory frequency signal on line 56 will be amplitude modulated to have a uniform amplitude modulation wave superposed thereon during the passage of a succession of good needles past test coil 16. By the action of Q5, Q6, this modulation signal on line 57 is applied to the input of an operational amplifier 58 biased to a selected DC level provided by adjustable tap 59 on bias resistor 61. Selection of the voltage level at tap 59 for the operational amplifier 58 permits output signals on line 62 to emphasize the difference between good needles and bad needles by exaggerating the amplitude difference therebetween and setting the level of the signal at line 62 for a bad needle at a predetermined point.

The signals on line 62 are applied to a saturated amplifier bad needle detector circuit 63 comprising two amplifier stages Q7 and Q8 with a bias adjustment 64 for the input to Q8. Adjustment of the bias 64 to saturate Q8 permits the negative going edge of the positive pulse output of Q7 to produce positive pulse outputs at the collector of Q8 on line 65. These positive signals for good needles on line 65 are normally short circuited to ground through a conducting transistor Q10 as will now be described.

The signals on line 62 are the waveforms C hereinafter described and are applied through a 4.7 volt Zener diode 66 in a good needle amplifier circuit 67. Good needle signals on line 62 having sufficient amplitude to overcome the Zener 4.7 volt threshold of diode 66 appear at the output of transistor Q9 on the collector thereof at line 68. The collector resistor in the output of Q9 has a pulse stretching capacitor 71 in parallel therewith such that the signal D on line 68 is broadened to cover the time duration of good needle signals appearing on line 65. This positive signal on line 68 keeps transistor Q10 conducting to short circuit the good needle signals on line 65 to ground thereby providing no active signal on line 72 during the passage of good needles past test coil 16.

Upon the occurrence of a bad needle having either a broken tip or bent in such a manner as to adequately influence the inductance of coil 16, lower level modulation pulses appear and when these lower level pulses occur on line 62 only the amplifier 63 reproduces them as an output on line 65 since such pulses are selected by the adjustment of bias 59 to have an amplitude lower than the threshold voltage of Zener 66. Thus for bad needle positive pulses on line 65 there will be no corresponding signal on line 68 and transistor Q10 will be cut off permitting positive bad needle signal on line 65 to appear on line 72 and be applied to trigger an SCR 73. The SCR 73 is connected to control a relay 74 operating to stop the knitting machine whenever the SCR 73 is triggered to conduct.

Referring now to FIG. 5, the operation of the circuit of FIG. 4 will be briefly reviewed to emphasize the previously described operating conditions. Oscillators 52, 53 are tuned to operate at approximately the same frequency and lock-in occurs by virtue of the bidirectional energy transfer between the oscillators provided by coupling represented as resistor 55. Other forms of energy coupling between the oscillators are, of course, possible. The outputs from the two oscillators are in frequency synchronization but their phase displacement is determined by the resonant parameters of the respective oscillators and these parameters for oscillator 52 vary between predetermined limits depending upon the presence or absence of a needle at a relative maximum field position for test coil 16. Thus a sequence of good needles produces a modulation due to the phase shift between oscillator 52 and 53 as the good needles pass the test coil 16. This modulation of the oscillator frequency 75 is shown as waveform 76. When a bad needle passes the coil 16 the modulation is reduced as indicated at 77 in FIG. 5A.

The output on line 56 of the Q3, Q4 circuit which adds the outputs of oscillators 52 and 53 appears as the modulation envelop on line 57 as shown in FIG. 5B. The different amplitude signals between a good needle pulse 76' and bad needle pulse 77' is preserved in the detection process provided by Q5 and Q6 and the output is filtered to remove the carrier frequency component provided by the oscillators. The waveform of FIG. 5B as thus derived is shaped and the amplitude difference accentuated by the operational amplifier 58 which provides on its output line 62 the waveform of FIG. 5C. Adjustment of the bias control 59 prmits selection of the amplitude of a good needle relative to that of a bad needle to be respectively on line 62 greater than and less than the threshold voltage of Zener diode 66.

The signal on line 62 as shown in FIG. 5C proceeds to amplifier circuit 63 (FIG. 4) to produce on line 65 the waveform 5E which by virtue of the bias adjustment 64 provides positive saturated pulses for both good and bad needles. The waveform of FIG. 5C applied to Zener 66 operates transistor Q9 only in response to good needles since the bad needle signals are blocked by the threshold level of Zener 66. These good needle signals are broadened by the time constant provided by the collector load resistor and capacitor 71 corresponding generally to the timed occurrence of needle pulses determined by the speed of operation of the machine and the needle spacing. These broadened pulses shown in FIG. 5D render transistor Q10 conductive and short circuit good needle signals on line 65 to ground so that the signal component at line 65 for good needle signals is zero. The absence of bad needle signals on line 68, FIG. 5D, permits transistor Q10 to remain cutoff and the bad needle signal component on line 72 is a saturated positive pulse occuring at the time of bad needles only as shown in FIG. 5E. These bad needle pulses are applied to trigger the SCR 73 and stop operation of the knitting machine.

While a particular circuit has been shown for selecting and providing stop motion for the knitting machine in response to sensing the knitting machines needles one at a time and detecting a single defective needle, it will be apparent that other circuits for this purpose can be used and, accordingly, the invention is not to be considered as limited to the particular circuit shown.

I claim:

1. In combination with a knitting machine having a plurality of needles arranged around the periphery of said machine and adapted to move in a peripheral path about the machine frame during the knitting operation of the machine with means at a predetermined location in said path for projecting said needles to expose the ends thereof as they move in sequence past said location, a first oscillating circuit having a frequency determining tuned circuit for producing oscillatory energy at the oscillating frequency, a test coil at said location coupled to said tuned circuit for producing an inductive field at said oscillating frequency through which said needles sequentially move as they are projected at said location individually to pass through said field of said test coil during operation of said machine, a second oscillating circuit nominally operating at substantially the same frequency as said first oscillating circuit, a coupling for bidirectional transfer of oscillatory energy between said first and second oscillating circuits, said coupling maintaining said oscillating circuits in frequency step, means for setting a nominal phase relation between the oscillations of said first and second oscillating circuits which varies between predetermined values as needles of normal configuration pass through said field, means for producing demodulation signals having a first value corresponding to the difference between said predetermined values and having a second value resulting from the phase change produced by a neelde having an inductance altering abnormal configuration present in said field, and means responsive to said demodulation signals for enabling continuous running of said machine for said first value and for stopping operation of said machine in response to said second value.

2. Apparatus according to claim 1 in which the means responsive to said demodulation signals includes a threshold device and means for adjusting the relative levels of said demodulation signals and the threshold established by said threshold device for selecting only demodulation signals of said second value.

3. Apparatus according to claim 2 and including means responsive to said demodulation signals for increasing the difference between said first and second values prior to their being applied to said threshold device.

4. Apparatus according to claim 1 and including a threshold discriminator means, means for adjusting the relative amplitude levels of said demodulation signals of said first and second values to be on opposite sides of the threshold of said threshold discriminator means, means for applying said demodulation signals to said threshold discriminating means for producing a control signal, and means responsive to said demodulation signals and said control signal for stopping operation of said machine upon the occurrence of said demodulation signals of said second value.

5. The method of controlling a knitting machine to stop operation upon detection of a broken needle occurring in a uniform sequence of needles comprising the steps of, operating two similar oscillators tuned to approximately the same frequency with the frequency determining elements of one of said oscillators adapted to be repeatedly influenced by individual needles in a predetermined sequence of knitting needles as they normally appear during operation of said machine, moving the needles of the machine individually in sequence relative to said frequency determining elements to alter a frequency determining parameter thereof, coupling oscillatory energy between said oscillators to lock them in frequency step with predetermined phase and predetermined phase variation between presence and absence of good needles in said sequence, detecting said phase variation between said oscillators in response to said sequence, and controlling operation of said machine to run continuously for said phase variation produced by said sequence of good needles and to stop upon detection of the phase variation produced by one broken needle in said sequence.

* * * * *